United States Patent [19]

Swiontek

[11] Patent Number: 4,960,598

[45] **Date of Patent: * Oct. 2, 1990**

[54] PACKAGE ASSEMBLY INCLUDING A MULTI-SURFACE, MICROWAVE INTERACTIVE TRAY

[75] Inventor: Anthony J. Swiontek, Neenah, Wis.

[73] Assignee: James River Corporation, Norwalk, Conn.

[ * ] Notice: The portion of the term of this patent subsequent to Dec. 27, 2005 has been disclaimed.

[21] Appl. No.: 253,623

[22] Filed: Oct. 5, 1988

Related U.S. Application Data

[62] Division of Ser. No. 829,227, Feb. 14, 1986.

[51] Int. Cl.[5] ..... B65D 81/34

[52] U.S. Cl. ..... 426/107; 426/113; 426/118; 426/124; 426/234; 219/10.55 E

[58] Field of Search ..... 426/107, 243, 113, 118, 426/234; 220/410; 229/119, 120, 903, 905, 913

[56] References Cited

U.S. PATENT DOCUMENTS

| | | | |
|---|---|---|---|
| 1,905,119 | 4/1933 | Newton . | |
| 2,279,670 | 4/1942 | Ford et al. . | |
| 2,591,578 | 4/1952 | McNealy et al. . | |
| 2,617,577 | 11/1952 | Tardiff . | |
| 2,830,162 | 4/1958 | Copson et al. | 426/243 |
| 3,424,596 | 2/1969 | Sullivan | 426/113 |
| 3,876,131 | 4/1975 | Tolaas . | |
| 3,985,990 | 10/1976 | Levinson | 219/10.55 E |
| 3,985,991 | 10/1976 | Levinson | 219/10.55 E |
| 4,015,085 | 3/1977 | Woods . | |
| 4,065,583 | 12/1977 | Ahlgren . | |
| 4,096,948 | 6/1978 | Kuchenbecker . | |
| 4,112,833 | 9/1978 | Oda et al. . | |
| 4,137,333 | 1/1979 | Daswick | 426/120 |
| 4,143,647 | 3/1979 | Husslein et al. . | |
| 4,190,757 | 2/1980 | Turpin et al. | 426/234 |
| 4,228,945 | 10/1980 | Wysocki . | |
| 4,230,924 | 10/1980 | Brastad et al. . | |
| 4,260,060 | 4/1981 | Faller | 426/113 |
| 4,266,108 | 5/1981 | Anderson et al. . | |
| 4,267,420 | 5/1981 | Brastad . | |
| 4,279,374 | 7/1981 | Webinger | 426/113 |
| 4,355,757 | 10/1982 | Roccaforte . | |
| 4,360,107 | 11/1982 | Roccaforte . | |
| 4,390,554 | 6/1983 | Levinson . | |
| 4,390,555 | 6/1983 | Levinson . | |
| 4,398,077 | 8/1983 | Freedman et al. . | |
| 4,418,863 | 12/1983 | Kimbrell, Sr. . | |
| 4,505,391 | 3/1985 | Kuchenbecker . | |
| 4,538,732 | 9/1985 | Kuchenbecker . | |
| 4,553,010 | 11/1985 | Bohrer et al. . | |
| 4,555,605 | 11/1985 | Brown et al. . | |
| 4,590,078 | 5/1986 | Umina | 426/113 |
| 4,592,914 | 6/1986 | Kuchenbecker | 426/107 |
| 4,594,492 | 6/1986 | Maroszek . | |
| 4,603,052 | 7/1986 | El-Hag et al. | 426/523 |
| 4,777,053 | 10/1988 | Tobelmann et al. | 426/107 |
| 4,794,005 | 12/1988 | Swiontek | 426/107 |

*Primary Examiner*—Donald E. Czaja
*Assistant Examiner*—D. Workman
*Attorney, Agent, or Firm*—Sixbey, Friedman, Leedom & Ferguson

[57] ABSTRACT

A food package assembly of the type designed to serve the dual function of providing a package for shipment and storage of a prepared food and of microwave heating of the food in a manner producing a browning or crisping effect that is particularly adapted to the needs of foods, such as French bread pizzas and garlic bread, which cannot be crisped in a microwave oven via the use of a single planar microwave interactive crisping layer and which, due to the grease and/or vapor driven out of them cannot be heated in a microwave oven in a closely confined manner without becoming soggy. In accordance with preferred embodiments, a food product is received upon an inner tray member that coacts with an outer package body to cradle the food product so that the adjoining surface thereof will be crisped by a microwave interactive heating layer applied to the facing surface of the inner tray member. Additionally, venting is provided through openings at opposed ends of the outer package body and via venting channels formed between side wall portions of the inner tray member and adjoining inner wall portions of the outer package body, communication between the top side of the inner tray member and the venting channels being provided via venting holes and/or end edge recessing or notching in accordance with various embodiments.

10 Claims, 2 Drawing Sheets

PACKAGE ASSEMBLY INCLUDING A MULTI-SURFACE, MICROWAVE INTERACTIVE TRAY

This application is a divisional of application Ser. No. 829,227, filed Feb. 14, 1986.

TECHNICAL FIELD

This invention relates generally to the field of packages for the storing and microwave heating of foods, and more particularly to food packages of the type having a component that will produce a heating effect, when exposed to microwave energy, for the purpose of crisping or browning food contained thereon.

BACKGROUND ART

The usage of microwave ovens has grown tremendously in recent years and continues to increase. Associated with this growth in microwave oven usage has been a similar growth in the demand for microwaveable prepared foods. How ever, when suppliers of microwaveable prepared foods seek to introduce different food products, they are often faced with the problem of how to compensate for the difference in effect produced during heating of foods in a microwave oven, in comparison to heating in a conventional oven. Among these problems, is the common complaint of consumers to the effect that food cooked by microwave energy lacks the desired degree of brownness or crispness that foods, particularly those involving bread products such as pizzas and garlic bread, have when cooked in a conventional oven. To this end, various specialized packages have been developed which are designed to achieve microwave browning or crisping of food contained therein. However, many such specially developed packages are not adaptable to foods which, during heating have grease or vapor driven out of them or which become soggy in nature. Furthermore, specialized packages that have been designed to overcome some of these problems are often costly to produce.

One example of such specialized packaging is disclosed in U.S. Pat. No. 4,190,757 to Turpin et al. This patent discloses a carton for microwave heating of pizza including an interactive layer which converts microwave energy to heat for browning the pizza crust and a spacer element for elevating the interactive layer above the bottom wall of the carton. Due to the specialized configuration of the carton assembly, excessive cost and size may result from utilization of this design, and, moreover, because this carton has only a single planar panel of interactive material it does not provide an effective means for microwave heating of foods that are relatively thick or which do not provide a single relatively flat surface requiring crisping or browning.

Microwave packages utilizing interactive layers are also known which require some form of manipulation prior to use, such as the package disclosed in commonly assigned U.S. Pat. No. 4,553,010 to Bohrer and the package assembly disclosed in Brown et al U.S. Pat. No. 4,555,605. However, even though the packaging arrangements disclosed in these patents are extremely well suited for the microwave heating of certain types of food, such as popcorn in the case of the Bohrer package and Neopolitan (thin crust) pizza in the case of the Brown et al package assembly, these arrangements do not deal with the problems associated with microwave cooking of other types of foods, particularly those involving relatively thick bread crusts such as French bread type pizza and garlic bread, due to the planar nature of the support surface on which the interactive layer is provided for contact with a food item.

Outside of the field of packages for microwave heating of foods, it has been very conventional to provide paperboard cartons with removable food holding trays positioned therein. For example, U.S. Pat. No. 2,617,577 to Tardiff discloses a combination package having an outer carton within which a tart carrying tray is received for the purpose of holding ice cream tarts in place within the carton in fixed spaced relation to each other as well as the interior walls of the carton. To this end, the tray is formed, preferably from a single blank that has been suitably cut and scored to provide a base panel and side panels joined to the base by suitable parallel score lines. Furthermore, pairs of oppositely disposed cutouts or openings are formed in the side panels, which cooperate with each other in supporting the tarts. While such package arrangements are useful for their disclosed purposes, there has been no suggestion as to the possible use of such carton designs for microwave cooking and as a result, no suggestion as to how a microwave cooking package assembly, particularly one designed for producing a crisping or browning effect, might be derived.

DISCLOSURE OF THE INVENTION

In view of the foregoing, it is an object of the present invention to provide a food package assembly of the type designed to serve the dual function of providing a package for shipment and storage of a prepared food and of microwave heating of the food in a manner producing a browning or crisping effect, that is particularly adapted to the needs of foods, such as French bread pizzas and garlic bread, that cannot be suitably crispened in a microwave oven via the use of a single planar microwave interactive crisping layer and which, due to the grease and/or vapor driven out of them, cannot be heated in a microwave oven in a closely confined manner.

It is another object of the present invention to provide a novel and improved package assembly wherein an inner tray member is constructed to provide bottom and side crisping panels.

It is yet another object of this invention to provide a novel and improved package assembly wherein an inner tray member coacts with an outer carton to facilitate crisping of a food product received thereon during microwave heating thereof by being provided with means for venting grease and vapors generated from the food product away from the surfaces of the food.

In accordance with modified embodiments of the present invention, it is also an object to construct the tray insert so as to provide an air space beneath the bottom wall of the tray, particularly a static air space for promoting a more uniform heating of the food product.

It is a specific object in accordance with the present invention, whereby the preceding objects are achieved through the use of a tray member formed from a single paperboard heater blank that is designed to be folded into a shape providing a channel-like food receiving space wherein a food object will be cradled in close proximity to bottom and side surfaces thereof that have a microwave interactive heating layer thereon, and which may be provided with one or more vent holes via which grease and vapor may exit from the food receiving space into channel vents formed along the length of the package assembly, between the tray member and the outer package body.

The above and other objects and advantages of the present invention are achieved, in accordance with preferred embodiments of the present invention wherein the package assembly includes an outer package body in the form of a carton of microwaveable material of a one or multiple piece construction which is provided with openings and perforations, zipper knife cuts or cut scores in a manner that not only permits the carton to be completely closed, for shipping and storage, and opened for removal of the food, but also provides a vented microwave heating or cooking container by rupturing of panel portions defined by the perforations, zipper knife cuts or double cut scores so as to expose the openings. However, the outer package construction may take various forms, i.e., tri-seal carton, kliklock carton, bottom and top tray assembly, etc. Also, portions of the outer package body may be laminated to a foil shield to protect given areas.

The package assembly also includes an inner tray member of a length corresponding substantially to the length of the outer package body but which is at least partially narrower than the width of the outer package body so as to define spaces between the inner tray element and the outer package body, running the length of the package assembly, which may serve as vent channels. Furthermore, the inner tray element is folded from a flat paperboard heater blank into a cross sectional shape suited for relatively closely conforming to the cross-sectional profile of the food product so as to cradle it, placing a microwave interactive heating layer disposed thereon into proximity with the outer side and bottom surfaces of a food product intended to be placed thereon. The food receiving space defined by the inner tray member is designed to communicate with the vent channels, between the inner tray member and the outer package body by edge configurations at opposite ends thereof and/or, by way of vent holes provided in wall portions of the inner tray member.

In accordance with modified embodiments, the folding of the heater blank is carried cut in a manner providing legs for raising the bottom wall of the inner tray member above the bottom wall of the outer package body and, advantageously so as to provide a substantially static air space thereunder which will serve as a means for providing a more uniform distribution of heat, during heating or cooking in a microwave oven.

BEST MODE FOR CARRYING OUT THE INVENTION

Figure 1:
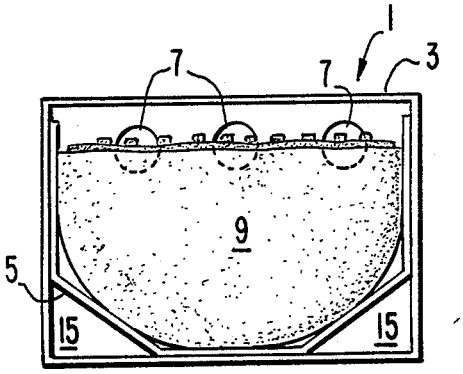
FIG. 1 is an end view of a package assembly, in accordance with a first embodiment of the present invention, with the end flaps removed to reveal the contents of the outer package body.
Figure 2:
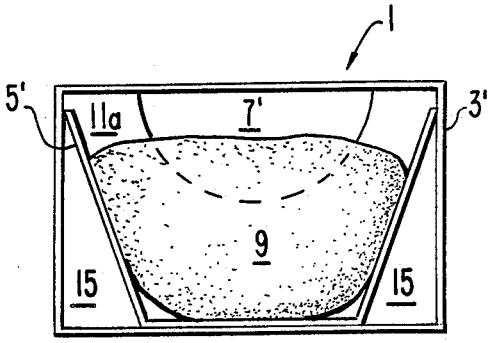
FIG. 2 is a view, similar to FIG. 1, of a modified embodiment.

With reference to FIGS. 1 and 2, the package assembly 1 in accordance with the present invention is comprised of two basic components, an outer package body which, in the illustrated embodiments, is in the form of a paperboard carton 3 or 3' and an inner tray member 5 or 5' comprised of five or three panel sections, respectively. As can be seen from FIG. 7, the cartons 3, 3' may have the configuration of an elongated rectangular parallelipiped, such being formable from a single blank so as to have a tubular packaging space defined by top, bottom, and a pair of side walls. The ends of carton 3, 3' are closable by first folding up a bottom wall flap **11*a*, which has a plurality of vent openings 7 or a single large vent cutout 7' therein, then folding across a pair of trapezoidal sidewall tabs 11*b*, followed by folding down of a top wall flap 11*c***.

Top wall flap **11*c* is subdivided into a central, trapezoidal section and a pair of triangular side edge portions by a pair of rupture lines 13 that may be in the form of perforations, cut scores, zipper knives, or the like. The side edge portions of the top wall flap 11*c* are sealed to the side wall tabs 11*b*, such as by gluing, in order to fully seal the inner tray 5, carrying the food item 9, within the outer package body formed by the carton 3 or 3' for shipping and storage purposes. However, the trapezoidal central portion of top wall flap 11*c* is left free of securement so that, to convert the package into a condition for microwave heating and cooking wherein the openings 7 or cutout 7' are exposed, the lower edge of the trapezoidal central portion of top wall flap 11*c* is grasped and pulled upward causing the trapezoidal center portion to separate from the triangular edge portions along the rupture lines 13. In this condition, gases and vapors generated from the food during heating thereof may be exhausted outwardly from the interior of the carton via the vent openings 7 or vent opening cutout 7'. In this regard, while the above described means for providing venting of the outer package body has been found to be effective, easy to produce and convenient to use, it is noted that numerous manners and means for providing venting in outer package body cartons are known, and any other known technique may be utilized to provide for venting of the outer package body via its longitudinally opposed ends or top. However, preferably, the vent openings encompass a significant extent of the top half thereof. For example, in an 8.5 cm wide by 4 cm high end flap, a semicircular cutout 7'** of approximately 2.2 cm radius has been found satisfactory, but the appropriate size may vary from product to product and thus should be determined empirically.

FIG. 1 illustrates a food product 9 in the nature of a French bread pizza. Such food items tend to have a mildly rounded bottom wall with relatively steep side walls. In such a circumstance, an inner tray member 5 with five panel portions can be used to effectively cradle the food item. On the other hand, breads as are used for garlic bread often times tend to be more trapezoidal in cross section, as shown for the food item 9 in FIG. 2, in which case an inner tray member with three panel portions may be more effective for cradling the food item 9. Of course, a larger odd number of panel portions with appropriate dimensioning thereof may also be used in order to effectively cradle the food item. In this regard, it is noted that the term "cradle" is used to mean that the top surface of the inner tray member 5, 5' surrounds the bottom and sides of the food product in intimate relationship therewith. By such cradling of the food product 9, a crisping of the bottom and sides of the food product can be achieved through the provision of a microwave interactive layer or coating upon the facing top surface of the inner tray member 5 or 5'.

FIGS. 3–6 show examples of some of the many potential forms that blanks for production of the inner tray members 5, 5' may take, in terms of the relative sizing of the bottom panel portion 17 and the side panel portions 19, and it should be appreciated that an infinite number of possibilities exist. In order to enable folding of the blanks into their cradling U-like shape, each of the panel portions is separated by, for example, a score line 21.

For some food products, such as some formulations of garlic bread, an inner tray member 5, 5' as described so far, may be sufficient. However, for various other food products, such as French bread pizzas, wherein a considerable amount of moisture will be vented, during heating, from the bread, in accordance with an important aspect of the invention, internal venting means is provided.

In particular, the width of the bottom panel portion 17 is always made less then the interior width of the outer carton 3, 3' so that the side panel portions 19 of the inner tray member 5, 5', adjoining the bottom panel portion 17 will be caused to angle upwardly and outwardly into contact with the side walls of the outer package body, thereby defining triangular vent channels 15 extending the length of the package assembly. In order to enable vapors driven out from the bread to enter into the vent channels 15, one or more vent holes are provided in the paperboard blanks of which the inner tray member 5, 5' is formed. Such a vent hole or holes should be located below the topping height since most moisture is vented from the bread, and it has been found to be particularly convenient to locate such vent holes at or near the score lines 21 at the longitudinally extending edges of the bottom panel 17.

As shown with reference to FIGS. 3–6, the vent holes 23 need not have a particular shape, circular, square, semi-circular, ovular and triangular shaped openings being just some of the myriad of shapes that are suitable. Furthermore, while blank **5'*a* shows the use of a line of vent holes along the length of the inner tray member, as shown with regard to tray blanks 5*a* and 5'*b*, a single centrally positioned, larger (for example ¾ inch) vent hole 23 can be utilized. Likewise, a pair of holes 23 of intermediate size (for example ½ inch) can be used near each of opposite ends of the inner tray member as illustrated with respect to inner tray member 5'*c***.

Figure 3:
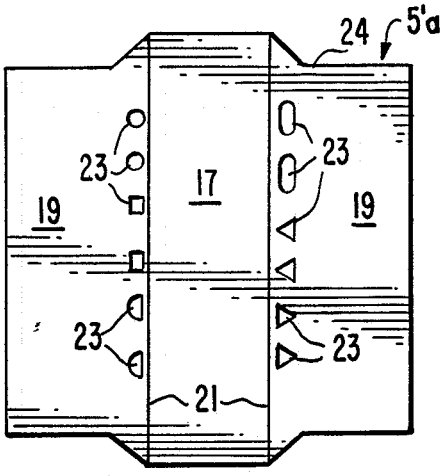
FIGS. 3–6 show blanks for modified inner tray members for use in accordance with outer package bodies as shown in either of the embodiments of FIGS. 1 and 2.
Figure 4:
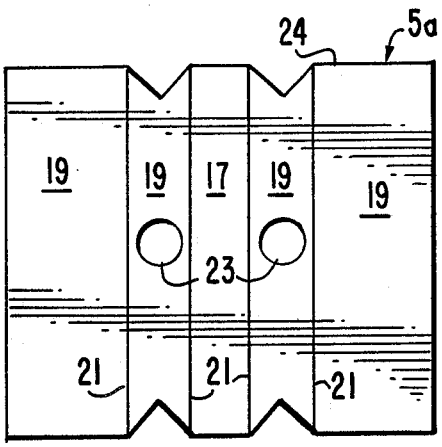
Figure 5:
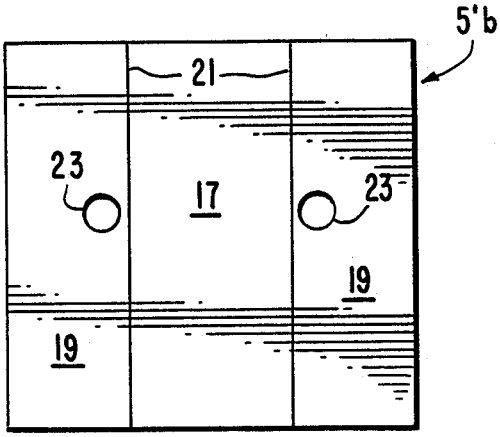
Figure 6:
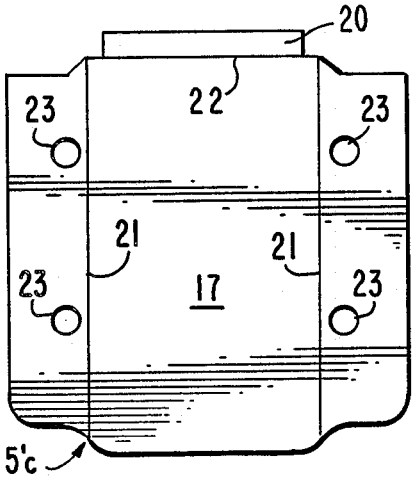

Although the inner tray member can be formed from a rectangular paperboard blank, as shown in FIG. 5, which corresponds in length to the internal length of the outer package body 3, 3', it has been found to be advantageous if the bottom panel portion 17 extends the full length of the interior of the outer package body, while at least a portion of the end edges 24 is notched or recessed inwardly or otherwise contoured at at least one panel portion thereof, as shown in FIGS. 3, 4 and 6, for example. Such a construction enables the vent channels 15 to be vented to the exterior of the package body via the vent openings 7 or vent cut-out 7' located at each end of the outer package body 3, 3', respectively by way of vent passages formed between the end flap **11*a* and the edge 24. For example, in FIG. 3, the side wall portions 19 are made of a lesser length than the bottom panel portion 17, except in a transition region where they adjoin while in FIG. 4, the side panel portions 19 are of equal length with respect to the bottom panel portion 17, but one of the side wall panel portions 19 is notched at opposite ends thereof. Furthermore, as shown for the end of tray member 5'*c* shown at the bottom of FIG. 6**, the same result can be achieved with an elimination of all corner areas through the use of a rounded contour. It is also noted that the vent openings or cut-outs could be in the side or top panels of the outer package body.

Also illustrated in FIG. 6 is the possibility of providing the inner tray member 5, 5' with a tab 20 that is connected to one end of the bottom panel portion by a fold line 22. By folding up of the tab 20 about the fold line 22, the tab 20 can serve to prevent the food product from sliding off of the bottom panel portion 17 when the opposite end of the inner tray member is used to pull the food product out of the interior of the outer package body 3, 3'.

Even though excellent results are obtainable with embodiments as described so far, it is known that heating of foods by microwave energy while supported upon a layer of microwave interactive material can produce improved results if the microwave interactive surface upon which the food product rests is elevated above the bottom wall of the package. Commonly assigned, co-pending U.S. patent application Ser. No. 504,388 to Kuchenbecker, discloses a vented outer package body within which an inner tray member is disposed, the inner tray member being covered with a layer of microwave interactive material. The inner tray member is formed of a single blank of paperboard stock in such a manner that it may be folded into a tray shape that, in conjunction with support provided by the outer package body, has a bottom panel portion which is held elevated above the bottom wall of the outer package body by leg portions formed by laterally adjoining panel portions of the blank of which the inner tray member is formed. However, in accordance with the disclosure of the Kuchenbecker application, the inner tray member is not designed to cradle the food product in the sense of the present invention, indicated above, and the width of the carton forming the outer package body is coordinated to the width of the inner tray member so as to result in the side panel portions being held essentially vertically in engagement with the inner surfaces of the side walls of the carton.

On the other hand, it has been determined, as part of the present invention, that inner tray members of the type disclosed in the Kuchenbecker application can be modified in accordance with the teachings of the present application so as to add the benefits of an elevated bottom crisping surface to the advantages obtained in accordance with the present invention. In particular, by utilizing a tray member as disclosed in the above-noted Kuchenbecker application (which is hereby incorporated by reference to the extent necessary to complete an understanding of the present application) that is provided with panel portions that are dimensioned to cradle a food item, such as a French bread pizza or garlic bread loaf, and that, in addition, are dimensioned so that, in the erected condition of the tray member within the outer package body, the inner side walls of the outer package body 3, 3' will essentially be contacted by side wall portions of the inner tray member only at the upper longitudinally extending edges thereof so that the vent channels 15, described above, will be obtained.

In order to enable communication of the vent channels 15 with the interactive layer side of inner tray member 5'', one or more vent openings 23 may be provided in the side wall panel portion 19, consistent with the points noted above with respect to the inner tray members of FIGS. 3–6. On the other hand, in accordance with the FIG. 9 embodiment, since the legs 26 are formed by cuts made in what would, otherwise, have been the bottom panel portion 17, when the inner tray member 5''' is disposed within an outer package body (wherein it will assume the orientation illustrated in FIG. 9), the cuts 30 will define the perimeter of holes in the bottom panel. Thus, by suitably configuring and dimensioning the legs 26', suitably sized vent holes can be achieved upon erecting of the tray blank into its in use configuration and no additional holes 23 need be provided.

Figure 7:
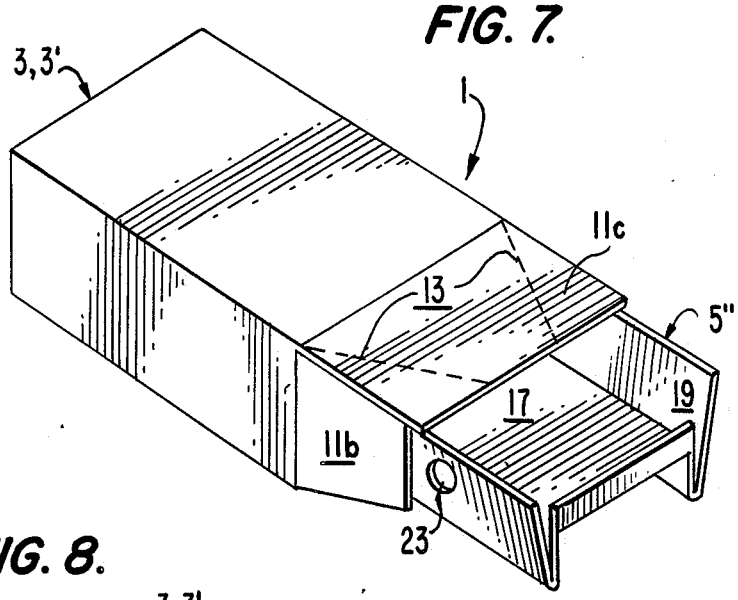
FIG. 7 is a front perspective view of an embodiment utilizing an inner tray element having legs for raising its bottom wall above the bottom wall of the outer package body.
Figure 8:
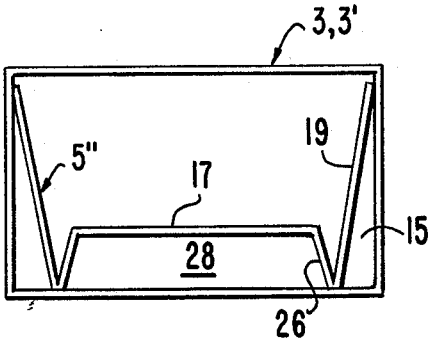
FIG. 8 is a view, similar to FIGS. 1 and 2, of the arrangement of FIG. 7.
Figure 9:
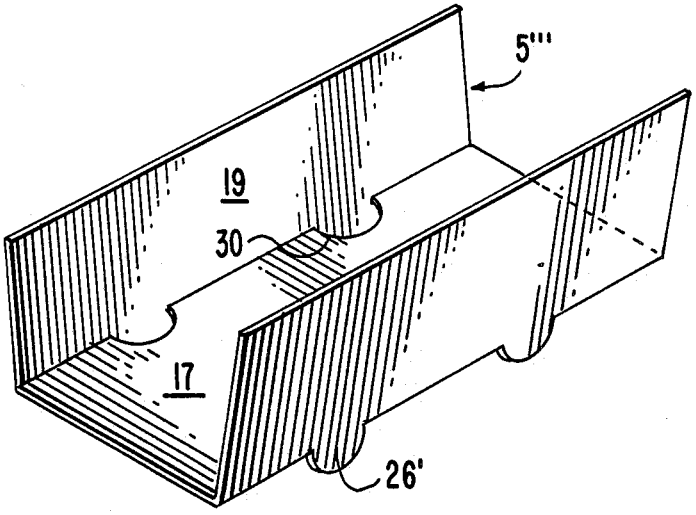
FIG. 9 is a perspective view of another form of inner tray member having legs for raising its bottom wall.

It is also pointed out that those of ordinary skill in the art w ill recognize that the ability to create an air space 28 below the bottom panel portion 17 of an inner tray member can be achieved by means other than the provision of unitary leg formations as depicted in FIGS. 7–9. For example, such a result could be achieved with inner tray members as depicted in FIG. 1–6 through means of a corrugated paperboard spacer or supports formed as part of the outer package body itself as described in the above-cited Turpin et al patent, or other equivalent means. However, it is pointed out that any means which results in the air space 28 being essentially closed or static (i.e., there is no significant air flow therethrough) is preferable since the temperature of the air within such an air space w ill become elevated during heating or cooking of a food product in a microwave oven and thus will serve to produce a more uniformly heated product. In this regard, it is noted that the concept of utilizing a closed or static air space for producing a more uniform heating of a food item on a microwave interactive layer thereover is disclosed in the above-cited commonly owned U.S. patent to Brown et al.

With respect to the vent channels 15, it is noted that the size thereof should be determined empirically for the particular food product involved and the spacing between the body edge of the side wall panel portions and the interior surface of the side wall of the outer package body will vary. However, from a practical standpoint, determination of the size of the venting channels will require a balancing between the size needed to obtain optimum venting and the competing desire to make the outer package body as small as possible in order to minimize production costs as well as the space required to ship, store, or display the package assembly.

Still further, taking into consideration the fact that the inner tray member is not self-sustaining in the conditions illustrated in FIGS. 1, 2 and 7–9, exact centering of the tray 5, 5', 5'', 5''' is unlikely and some shifting w ill occur as well. Thus, it is desirable that some minimum size differential be maintained between the inner tray member and the outer package body within which it is received. By way of example, it has been found to be satisfactory if the inner tray members are designed such that, in the condition of the insert member within the outer package body, the width of the bottom panel portion 17 (or in the case of the embodiment of FIG. 7, 8 the distance between the bottom edges of the supporting legs 26 which support the bottom panel portion 17 above static air space 28) is at least approximately 10 mm less than the width of the bottom wall of the outer package body 3, 3'.

From the foregoing, it should be appreciated that the present invention provides a package assembly for shipping, storage and heating or cooking or microwaveable prepared foods that will be adaptable to various modifications in usage and construction that will be apparent to those of ordinary skill in the art.

INDUSTRIAL APPLICABILITY

This invention has particular utility in the packaging of food for distribution and sale in refrigerated and frozen display cases as well as subsequent use by the consumer in the microwave heating or cooking of the food item packaged therein, especially foods that are prone to becoming soggy during microwave heating and which require browning or crisping of a non-planar surface or surfaces thereof.

I claim:

1. Package assembly for the storing and microwave heating of a food item comprising:

(a) an outer package body defining an internal food receiving space;

(b) a food item within said food receiving space; and (c) tray member disposed in the food receiving space of the outer package body and being formed of a microwave transparent material upon which a layer of a microwave interactive material, that is capable of converting microwave energy to heat, is disposed on one side thereof; wherein said tray member has a flat bottom wall for supporting said tray member, in use, upon a flat surface within a microwave oven for heating of the food item, and has upwardly directed sidewalls which, together with said flat bottom wall are sized and shaped relative to the food item so as to cradle the food item with multiple surfaces of the food item in sufficient proximity with respect to the microwave interactive layer for producing browning or crisping of said multiple surfaces during heating of the food item within the tray member in a microwave oven; and wherein a plurality of vent holes are formed in portions of said sidewalls in a vicinity of said bottom wall at each of opposite sides of the food item as a means for venting of gases and vapor released by the food item within said inner tray member during heating of the food item, away from said food item out of the tray member through said sidewalls.

2. Package assembly according to claim 1, wherein said tray member is formed of a paperboard blank that has a bottom panel portion and a plurality of side panel portions defined by fold lines extending the length thereof, said blank being folded about said fold lines into a U-like cross-sectional shape.

3. Package assembly according to claim 2, further comprising means for supporting said bottom panel portion in an elevated condition for heating of the food item above a static air space.

4. Package assembly according to claim 2, wherein said means for supporting comprises leg means formed as an integral part of said inner tray member.

5. Package assembly according to claim 3, wherein said means for supporting comprises a corrugated paperboard spacer.

6. Package assembly according to claim 1 further comprising means for supporting said flat bottom wall in an elevated condition above a static air space.

7. Package assembly according to claim 6, wherein said means for supporting comprises leg means formed as an integral part of said inner tray member.

8. Package assembly according to claim 6, wherein a tab portion extends upwardly at an end of said bottom wall.

9. Package assembly according to claim 1, wherein the outer package body is a paperboard carton.

10. Package assembly according to claim 1, wherein said food item is a bread product having a crust thickness of the type found on french bread pizza and garlic bread and said tray member is capable of serving as a means for producing a crisping of said crust in manner that is free of soggy spots.

* * * * *